US011615909B2

(12) United States Patent
Li et al.

(10) Patent No.: US 11,615,909 B2
(45) Date of Patent: Mar. 28, 2023

(54) COIL COMPONENT

(71) Applicant: TDK CORPORATION, Tokyo (JP)

(72) Inventors: Ge Li, Tokyo (JP); Masahiro Gamou, Tokyo (JP)

(73) Assignee: TDK CORPORATION, Tokyo (JP)

( * ) Notice: Subject to any disclaimer, the term of this patent is extended or adjusted under 35 U.S.C. 154(b) by 211 days.

(21) Appl. No.: 17/128,387

(22) Filed: Dec. 21, 2020

(65) Prior Publication Data

US 2021/0193363 A1 Jun. 24, 2021

(30) Foreign Application Priority Data

Dec. 23, 2019 (JP) ..... JP2019-232039

(51) Int. Cl.
*H01F 27/26* (2006.01)
*H01F 27/28* (2006.01)

(52) U.S. Cl.
CPC ..... *H01F 27/26* (2013.01); *H01F 27/28* (2013.01)

(58) Field of Classification Search
CPC . H01F 27/26; H01F 27/28; H01F 3/14; H01F 2003/103; H01F 3/10; H01F 27/263
See application file for complete search history.

(56) References Cited

U.S. PATENT DOCUMENTS

| | | | | |
|---|---|---|---|---|
| 4,103,221 | A | 7/1978 | Fukui et al. | |
| 6,717,504 | B2 * | 4/2004 | Fujiwara | H01F 3/10 336/178 |
| 8,420,433 | B2 | 4/2013 | Jackson et al. | |
| 2012/0161917 | A1 * | 6/2012 | Henning, III | H01F 30/06 336/212 |
| 2013/0043969 | A1 * | 2/2013 | Ota | H01F 3/10 336/229 |

FOREIGN PATENT DOCUMENTS

| | | | |
|---|---|---|---|
| DE | 3202600 | A1 | 9/1982 |
| FR | 2 839 580 | A1 | 11/2003 |
| JP | H07-176431 | A | 7/1995 |

* cited by examiner

*Primary Examiner* — Tuyen T Nguyen
(74) *Attorney, Agent, or Firm* — Oliff PLC

(57) ABSTRACT

A coil component includes a first core having a leg portion, a second core joined to the first core with the leg portion therebetween, and a magnet disposed between the leg portion and the second core. Movement of the magnet in a first direction intersecting a direction in which the first core and the second core face each other is at least restricted by an uneven structure provided on a junction surface between the magnet and at least one of the first core and the second core.

3 Claims, 7 Drawing Sheets

COIL COMPONENT

CROSS REFERENCE TO RELATED APPLICATIONS

This application claims priority to Japanese Patent Application No. 2019-232039 filed on Dec. 23, 2019, the entire contents of which are incorporated by reference herein.

TECHNICAL FIELD

The present invention relates to a coil component.

BACKGROUND

In the related art, a coil component disclosed in Japanese Unexamined Patent Publication No. S50-133453 is known. This coil component is constituted by combining a first core and a second core. In addition, a magnet is disposed between the first core and the second core.

SUMMARY

Here, when a coil component vibrates, a magnet may be positionally dislocated. When a magnet is positionally dislocated in this manner, there is a problem of deterioration in DC superimposition characteristics of the coil component.

An object of the present invention is to provide a coil component in which positional dislocation of a magnet with respect to a core can be curbed.

According to the present invention, there is provided a coil component including a first core having a leg portion, a second core joined to the first core with the leg portion therebetween, and a magnet disposed between the leg portion and the second core. Movement of the magnet in a first direction intersecting an opposite direction in which the first core and the second core face each other is at least restricted by an uneven structure provided on a junction surface between the magnet and at least one of the first core and the second core.

In the coil component according to the present invention, the magnet is disposed between the leg portion of the first core and the second core. Accordingly, DC superimposition characteristics of the coil component are enhanced. Here, movement of the magnet in the first direction intersecting the opposite direction in which the first core and the second core face each other is at least restricted by the uneven structure. Therefore, even when the coil component vibrates, movement of the magnet at least in the first direction is restricted by the uneven structure. Accordingly, positional dislocation of the magnet with respect to the core can be curbed.

A pair of first restriction wall portions protruding in a manner of facing each other in the first direction are formed in at least one of the first core and the second core. Movement of the magnet in the first direction may be restricted by the first restriction wall portions. Accordingly, movement of the magnet in the first direction can be restricted by a simple structure of the pair of first restriction wall portions.

A pair of second restriction wall portions protruding in a manner of facing each other in a second direction intersecting the opposite direction and the first direction may be formed in at least one of the first core and the second core. Movement of the magnet in the second direction may be restricted by the second restriction wall portions. Accordingly, in addition to movement of the magnet in the first direction, movement of the magnet in the second direction can also be restricted.

A protruding portion protruding toward at least one of the first core and the second core may be formed in the magnet. Accordingly, the protruding portion of the magnet is fitted to at least one of the first core and the second core, and thus movement of the magnet can be restricted.

The first core may have the pair of leg portions, and the magnet may be disposed in at least one of the pair of leg portions. A coil portion may be disposed between the pair of leg portions.

According to the present invention, it is possible to provide a coil component in which positional dislocation of a magnet with respect to a core can be curbed.

DETAILED DESCRIPTION

Figure 1:
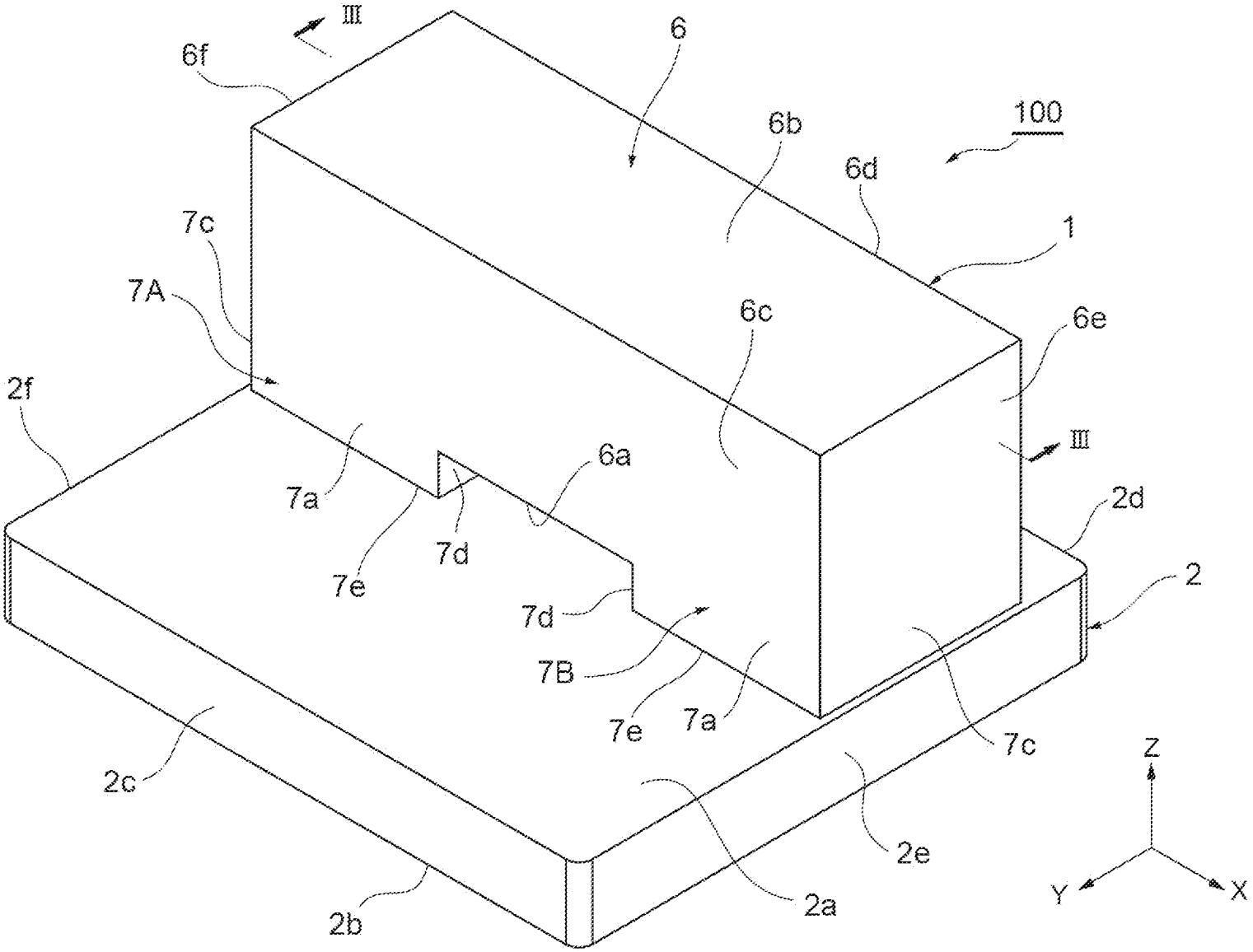
FIG. 1 is a plan view illustrating a coil component according to an embodiment of the present invention.
Figure 2:
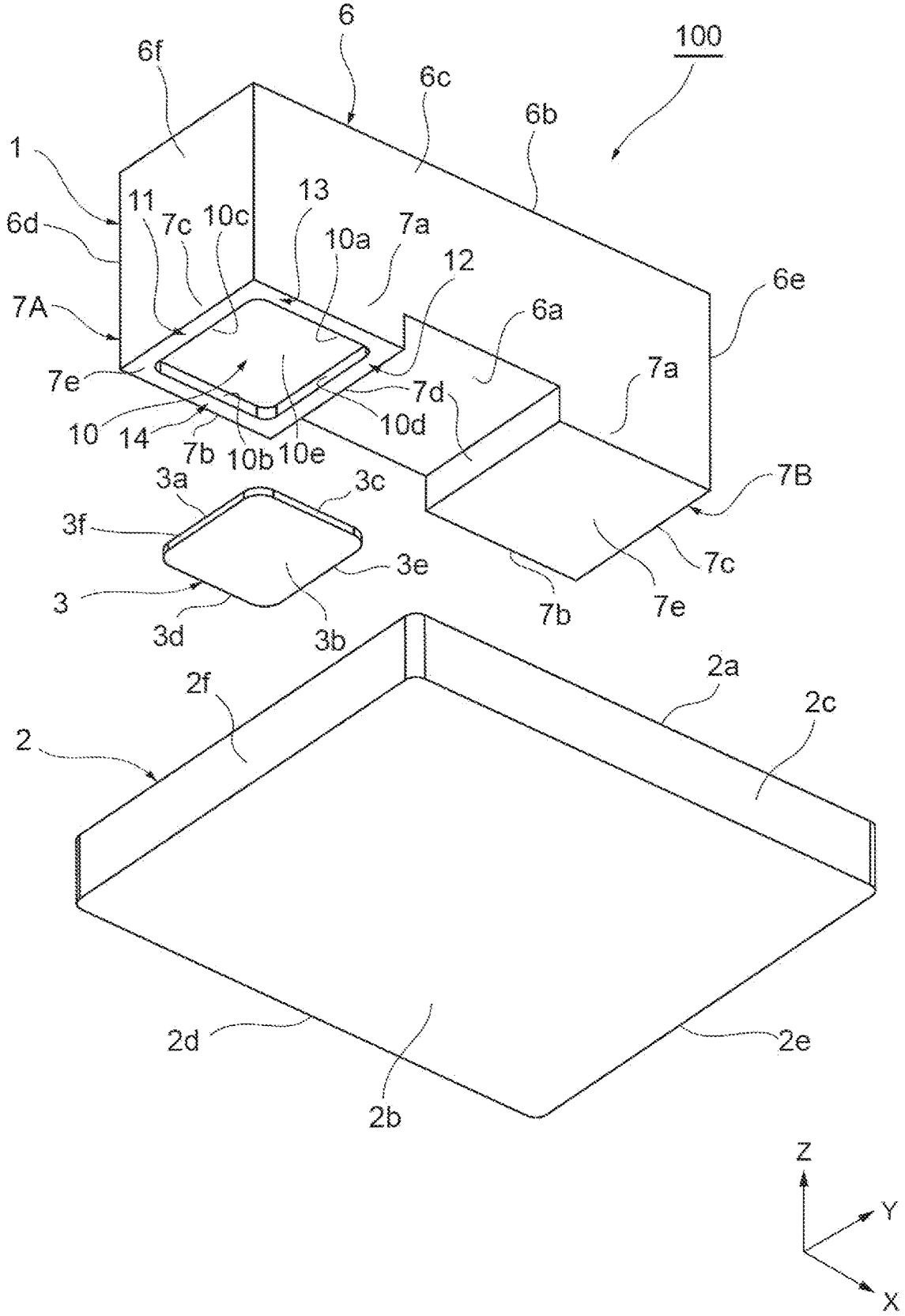
FIG. 2 is a development view of the coil component.

With reference to FIG. 1, a coil component according to an embodiment of the present invention will be described. FIG. 1 is a plan view illustrating a coil component 100 according to the embodiment of the present invention. FIG. 2 is a development view of the coil component 100.

As illustrated in FIGS. 1 and 2, the coil component 100 includes a first core 1, a second core 2, and a magnet 3 (refer to FIG. 2). An opposite direction in which the first core 1 and the second core 2 face each other will be referred to as a Z axis direction. The first core 1 side will be referred to as a positive side in the Z axis direction. A direction perpendicular to the Z axis direction will be referred to as an X axis direction, and a direction perpendicular to the Z axis direction and the X axis direction will be referred to as a Y axis direction. In the present embodiment, the X axis direction corresponds to "a first direction" in the claims, and the Y axis direction corresponds to "a second direction" in the claims. However, the directions are not limited to the foregoing correspondence relationship. When the Y axis direction is considered to correspond to "the first direction", the X axis direction corresponds to "the second direction".

The first core 1 is a U-shaped core. The first core 1 includes a main body portion 6 and a pair of leg portions 7A and 7B. The main body portion 6 forms a rectangular parallelepiped of which a longitudinal direction lies in the X axis direction. The main body portion 6 has a lower surface 6*a*, an upper surface 6*b*, side surfaces 6*c* and 6*d*, and end surfaces 6*e* and 6*f*. The lower surface 6*a* expands parallel to an XY plane at a position on a negative side in the Z axis direction. The upper surface 6*b* expands parallel to the XY plane at a position on the positive side in the Z axis direction. The side surfaces 6*c* and 6*d* individually expand parallel to an XZ plane at positions on the positive side and the negative side in the Y axis direction. The end surfaces 6*e* and 6*f* expand parallel to a YZ plane at positions on the positive side and the negative side in the X axis direction.

The leg portions 7A and 7B protrude from the lower surface 6*a* of the main body portion 6 toward the negative side in the Z axis direction. The leg portion 7A is provided at an end portion of the main body portion 6 on the negative side in the X axis direction. The leg portion 7B is provided at another end portion of the main body portion 6 on the positive side in the X axis direction. The leg portion 7A and the leg portion 7B are separated from each other in the X axis direction.

The leg portions 7A and 7B have a rectangular shape when viewed in the Z axis direction. Each of the leg portions 7A and 7B has side surfaces 7*a*, 7*b*, 7*c*, and 7*d* and a lower surface 7*e*. The side surfaces 7*a* and 7*b* expand parallel to the XZ plane at respective positions on the positive side and the negative side in the Y axis direction. The side surfaces 7*c* and 7*d* expand parallel to the YZ plane at respective positions on sides inward and outward in the X axis direction. A side outward in the X axis direction is based on the longitudinal direction of the main body portion 6 and indicates the side of the end surfaces 6*e* and 6*f*. The lower surface 7*e* expands parallel to the XY plane at a position on the negative side in the Z axis direction. A recess 10 (refer to FIG. 2) is formed on the lower surface 7*e* of the leg portion 7A. A detailed constitution of the recess 10 will be described below. In the present embodiment, the side surfaces 7*a* and 7*b* of the leg portions 7A and 7B are respectively flush with the side surfaces 6*c* and 6*d* of the main body portion 6. The side surface 7*c* of the leg portion 7A is flush with the end surface 6*e* of the main body portion 6. The side surface 7*c* of the leg portion 7B is flush with the end surface 6*f* of the main body portion 6. However, the shapes of the leg portions 7A and 7B, the positional relationship with respect to the main body portion 6, and the like are not particularly limited.

The second core 2 is an I-shaped core. The second core 2 is joined to the first core 1 with the leg portions 7A and 7B therebetween. The second core 2 has a rectangular plate shape expanding parallel to the XY plane. The second core 2 has an upper surface 2*a*, a lower surface 2*b*, and side surfaces 2*c*, 2*d*, 2*e*, and 2*f*. The upper surface 2*a* expands parallel to the XY plane at a position on the positive side in the Z axis direction. The lower surface 2*b* expands parallel to the XY plane at a position on the negative side in the Z axis direction. The side surfaces 2*c* and 2*d* individually expand parallel to the XZ plane at positions on the positive side and the negative side in the Y axis direction. The side surfaces 2*e* and 2*f* expand parallel to the YZ plane at positions on the positive side and the negative side in the X axis direction.

The first core 1 is connected to the upper surface 2*a* of the second core 2. The lower surfaces 7*e* of the leg portions 7A and 7B of the first core 1 are disposed such that they are close to or in contact with the upper surface 2*a* of the second core 2 and parallel thereto. In the present embodiment, the first core 1 is disposed in a region on the negative side in the Y axis direction on the upper surface 2*a* of the second core 2.

As illustrated in FIG. 2, the magnet 3 is disposed between the leg portion 7A and the second core 2. The magnet 3 is a rectangular-plate-shaped permanent magnet expanding parallel to the XY plane. The magnet 3 has an upper surface 3*a*, a lower surface 3*b*, and side surfaces 3*c*, 3*d*, 3*e*, and 3*f*. The upper surface 2*a* expands parallel to the XY plane at a position on the positive side in the Z axis direction. The lower surface 3*b* expands parallel to the XY plane at a position on the negative side in the Z axis direction. The side surfaces 3*c* and 3*d* individually expand parallel to the XZ plane at positions on the positive side and the negative side in the Y axis direction. The side surfaces 3*e* and 3*f* expand parallel to the YZ plane at positions on the positive side and the negative side in the X axis direction. The magnet 3 is disposed inside the recess 10 formed on the lower surface 7*e* of the leg portion 7A. Accordingly, the magnet 3 is disposed inside a region surrounded by the side surfaces 7*a*, 7*b*, 7*c*, and 7*d* of the leg portion 7A when viewed in the Z axis direction.

Figure 3:
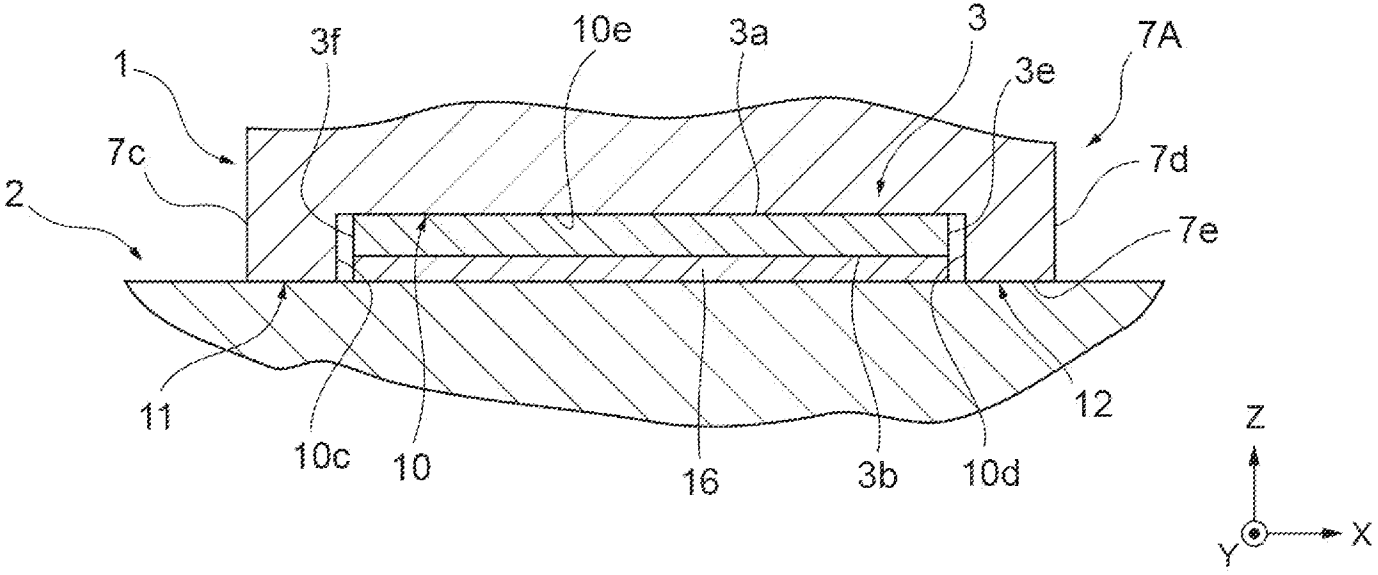
FIG. 3 is a cross-sectional view along line III-III in FIG. 1.

Next, with reference to FIGS. 2 and 3, a constitution in the vicinity of the recess 10 of the leg portion 7A will be described. FIG. 3 is a cross-sectional view along line III-III in FIG. 1. The recess 10 is a recessed portion recessed from the lower surface 7*e* of the leg portion 7A to the positive side in the Z axis direction. The recess 10 functions as an uneven structure (concavo-convex structure) for restricting movement of the magnet 3 in the X axis direction and the Y axis direction on the lower surface 7*e* of the leg portion 7A. The uneven structure is a structure provided on a junction surface between the magnet 3 and at least one of the first core 1 and the second core 2. In the present embodiment, the uneven structure is provided on the junction surface (the lower surface 7*e* of the leg portion 7A) between the first core 1 and the magnet 3. The uneven structure is a structure including a recessed structure, a projecting structure, and a structure including both a recessed shape and a projecting shape in a broad sense. In the present embodiment, the recessed structure is constituted by the recess 10. The recess 10 has a rectangular shape when viewed in the Z axis direction. The depth (dimension in the Z axis direction) of the recess 10 is larger than the thickness of the magnet 3. The recess 10 has inner side surfaces 10*a*, 10*b*, 10*c*, and 10*d*, and a bottom surface 10*e*.

The inner side surfaces 10*a*, 10*b*, 10*c*, and 10*d* are surfaces that rise from four side portions of the bottom surface 10*e* toward the negative side in the Z axis direction. The inner side surface 10*a* extends in the X axis direction at a position corresponding to the side portion of the bottom surface 10*e* on the positive side in the Y axis direction. The inner side surface 10*b* extends in the X axis direction at a position corresponding to the side portion of the bottom surface 10*e* on the negative side in the Y axis direction. The inner side surfaces 10*a* and 10*b* face each other in a state in which they are separated from each other in the Y axis direction and parallel to the XZ plane. The inner side surface 10*c* extends in the Y axis direction at a position corresponding to the side portion of the bottom surface 10*e* on the negative side in the X axis direction. The inner side surface 10*d* extends in the Y axis direction at a position corresponding to the side portion of the bottom surface 10*e* on the positive side in the X axis direction. The inner side surfaces 10*c* and 10*d* face each other in a state in which they are separated from each other in the X axis direction and parallel to the YZ plane.

Since the recess 10 is formed as described above, a pair of restriction wall portions 11 and 12 (first restriction wall portions) protruding in a manner of facing each other in the X axis direction are formed in the first core 1. In addition, a pair of restriction wall portions 13 and 14 (second restriction wall portions) protruding in a manner of facing each other in the Y axis direction are formed in the first core 1.

The restriction wall portions 11 and 12 are wall portions respectively having the inner side surfaces 10*c* and 10*d* on an inner circumferential side. The restriction wall portions 11 and 12 are wall portions protruding from the bottom surface 10*e* to the negative side in the Z axis direction and extending in the Y axis direction at positions on the side surfaces 7*c* and 7*d* of the leg portion 7A. The restriction wall portions 11 and 12 extend from the side surface 7*a* of the leg portion 7A to a position leading to the side surface 7*b*. That is, the restriction wall portions 11 and 12 are formed throughout the entire region of the leg portion 7A in the Y axis direction.

The restriction wall portions 13 and 14 are wall portions having the inner side surfaces 10*a* and 10*b* on an inner circumferential side. The restriction wall portions 13 and 14 are wall portions protruding from the bottom surface 10*e* to the negative side in the Z axis direction and extending in the X axis direction at positions on the side surfaces 7*a* and 7*b* of the leg portion 7A. The restriction wall portions 13 and 14 extend from the side surface 7*c* of the leg portion 7A to a position leading to the side surface 7*d*. That is, the restriction wall portions 13 and 14 are formed throughout the entire region of the leg portion 7A in the X axis direction. In addition, end portions of the restriction wall portions 13 and 14 on both sides are joined to the restriction wall portions 11 and 12. Accordingly, the recess 10 is surrounded by the inner side surfaces 10*a*, 10*b*, 10*c*, and 10*d* throughout the circumference with no gap therebetween. The restriction wall portions 11, 12, 13, and 14 are not each required to extend in the entire regions in the longitudinal direction and may be partially cut out.

When the lower surface 7*e* of the leg portion 7A of the first core 1 is disposed on the upper surface 2*a* of the second core 2, an opening portion of the recess 10 is blocked by the upper surface 2*a*. Accordingly, an internal space is formed by the recess 10 between the first core 1 and the second core 2. The magnet 3 is disposed inside the internal space (refer to FIG. 3). In the internal space, the magnet 3 is in a state in which the upper surface 3*a* and the bottom surface 10*e* of the recess 10 face each other in the Z axis direction and the lower surface 3*b* and the upper surface 2*a* of the second core 2 face each other in the Z axis direction. In the present embodiment, the upper surface 3*a* of the magnet 3 comes into contact with the bottom surface 10*e* of the recess 10. In addition, the lower surface 3*b* of the magnet 3 comes into contact with a gap sheet 16 disposed on the upper surface 2*a*. Accordingly, the magnet 3 is sandwiched between the first core 1 and the second core 2. However, the positional relationships between the magnet 3 and the bottom surface 10*e* and between the magnet 3 and the upper surface 2*a* are not particularly limited. The magnet 3 need only be sandwiched between the first core 1 and the second core 2.

In addition, in the internal space formed by the recess 10, the magnet 3 is disposed in a state in which movement thereof in the X axis direction is restricted by the restriction wall portions 11 and 12. In addition, the magnet 3 is disposed in a state in which movement thereof in the Y axis direction is restricted by the restriction wall portions 13 and 14. Specifically, the magnet 3 is disposed such that a side surface 3*f* faces the inner side surface 10*c* of the restriction wall portion 11 in the X axis direction and the side surface 3*e* faces the inner side surface 10*d* of the restriction wall portion 12 in the X axis direction. In addition, the magnet 3 is disposed such that the side surface 3*c* faces the inner side surface 10*a* of the restriction wall portion 13 in the Y axis direction and the side surface 3*d* faces the inner side surface 10*b* of the restriction wall portion 14 in the Y axis direction. A gap may be formed between each of the side surfaces of the magnet 3 and one of the restriction wall portions. However, when movement of the magnet 3 is restricted, each of the side surfaces of the magnet 3 abuts one of the restriction wall portions.

When the recess 10 is formed as described above, a shape corresponding to the recess 10 is formed in a die used for molding the first core 1.

Next, operation and effects of the coil component 100 according to the present embodiment will be described.

In the coil component 100 according to the present embodiment, the magnet 3 is disposed between the leg portion 7A on one side of the first core 1 and the second core 2. Accordingly, DC superimposition characteristics of the coil component 100 are enhanced. Here, movement of the magnet 3 in the X axis direction and the Y axis direction intersecting orthogonal to the Z axis direction which is the opposite direction in which the first core 1 and the second core 2 face each other is restricted due to the recessed structure of the recess 10. Therefore, even when the coil component 100 vibrates, movement of the magnet 3 in the X axis direction and the Y axis direction is restricted by the recessed structure of the recess 10. Accordingly, positional dislocation of the magnet 3 with respect to the cores 1 and 2 can be curbed. In addition, at the time of manufacturing, since positioning is completed by inserting the magnet 3 into the recess 10, positioning and mounting of the magnet 3 are facilitated. Therefore, mass production efficiency of the coil component 100 can be improved.

The pair of restriction wall portions 11 and 12 protruding in a manner of facing each other in the X axis direction are formed in the first core 1, and movement of the magnet 3 in the X axis direction is restricted by the restriction wall portions 11 and 12. Accordingly, movement of the magnet 3 in the X axis direction can be restricted by a simple structure of the pair of restriction wall portions 11 and 12.

The pair of restriction wall portions 13 and 14 protruding in a manner of facing each other in the Y axis direction are formed in the first core 1, and movement of the magnet 3 in the Y axis direction is restricted by the restriction wall portions 13 and 14. Accordingly, in addition to movement of the magnet 3 in the X axis direction, movement of the magnet 3 in the Y axis direction can also be restricted.

Figure 7:
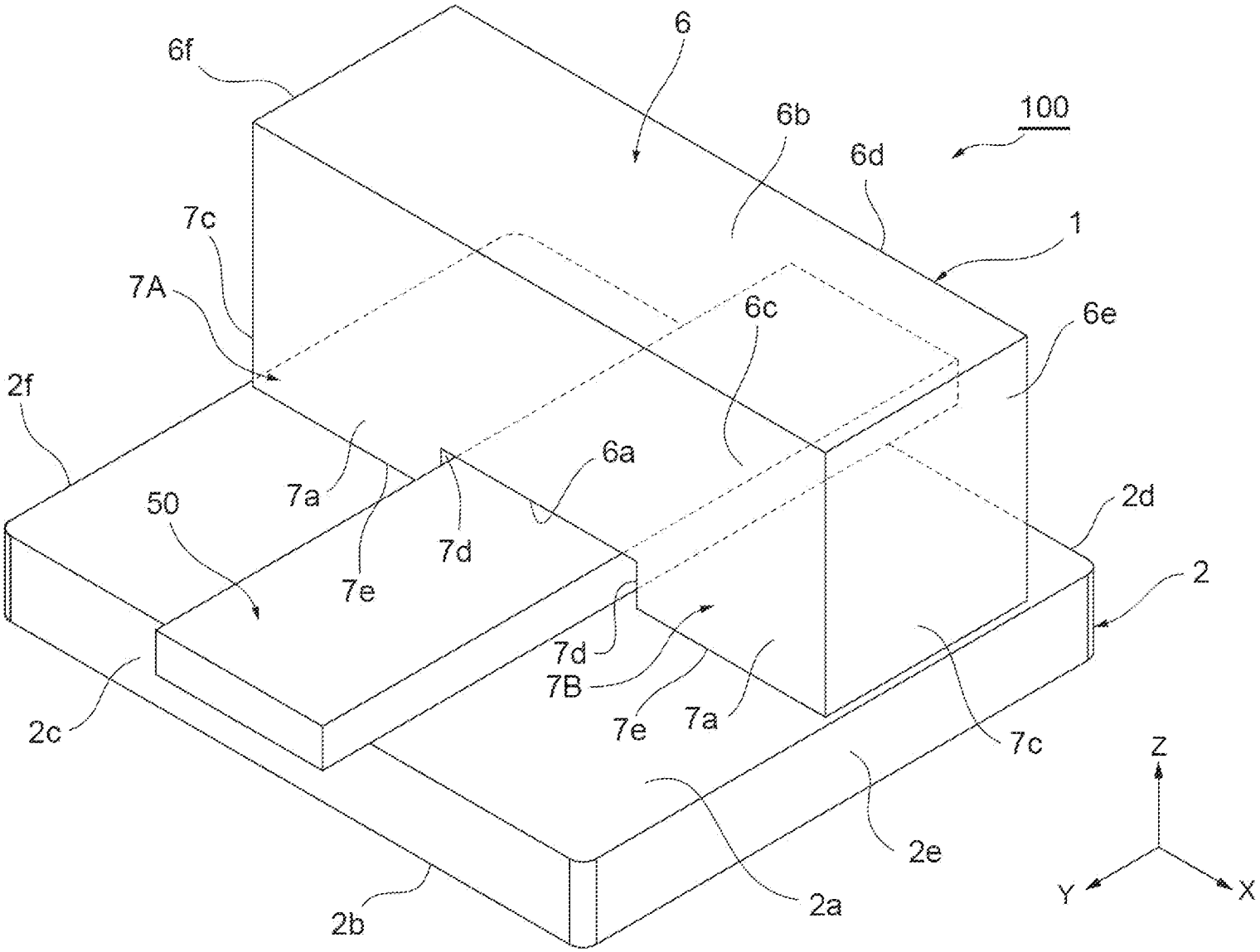
FIG. 7 is a view illustrating the coil component in which a coil portion is illustrated.

Here, FIG. 7 is a perspective view illustrating a disposition example when a coil portion 50 is disposed in the coil component 100. As illustrated in FIG. 7, the first core 1 has the pair of leg portions 7A and 7B. The magnet 3 is disposed in at least one of the pair of leg portions 7A and 7B, and the coil portion 50 is disposed between the pair of leg portions 7A and 7B. The coil portion is a sheet metal coil, a pattern coil in a substrate (multi-layer substrate), or the like.

The present invention is not limited to the embodiment described above.

Figure 4:
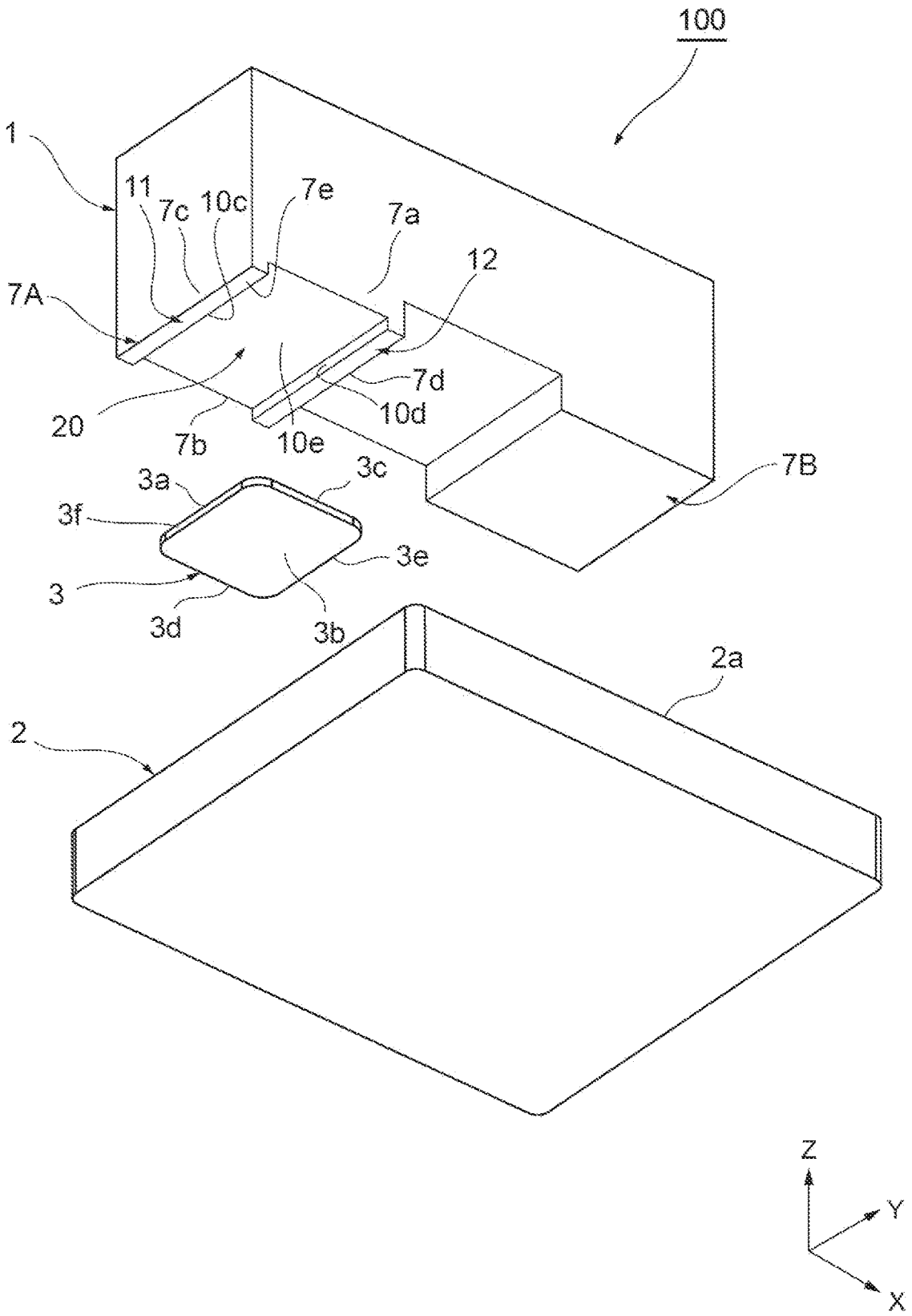
FIG. 4 is a development view of the coil component according to a modification example.

For example, the coil component 100 illustrated in FIG. 4 may be employed. In the coil component 100, a recess 20 formed in the leg portion 7A has a structure different from that of the recess 10 illustrated in FIG. 2. The recess 20 has the inner side surfaces 10*c* and 10*d* and the bottom surface 10*e* but is constituted to penetrate the leg portion 7A in the Y axis direction. The recess 20 opens to the positive side in the Y axis direction on the side surface 7*a* and opens to the negative side in the Y axis direction on the side surface 7*b*. That is, in the structure illustrated in FIG. 4, the first core 1 has the restriction wall portions 11 and 12 facing each other in the X axis direction but does not have the restriction wall portions 13 and 14 (refer to FIG. 2) facing each other in the Y axis direction. In this case, movement of the magnet 3 in the X axis direction is restricted by the restriction wall portions 11 and 12 but movement of the magnet 3 in the Y axis direction is not restricted. When the structure is employed, the restriction wall portions 11 and 12 may be disposed to face each other in a vibration direction of the coil component 100 the vibration direction being found in advance. When the recess 20 is formed, similar to the recess 10, a corresponding shape may be provided in a die, or the recess 20 can be formed through cutting. That is, the recess 20 may be formed by cutting the flat surface-shaped lower surface 7*e* of the leg portion 7A. This is because a cutting tool can pass therethrough since the recess 20 penetrates the leg portion 7A in the Y axis direction.

The recess 10 or 20 is formed only in the leg portion 7A. However, when the magnet 3 is also disposed on the leg portion 7B side, the recess 10 or 20 may also be formed in the leg portion 7B. In addition, the recess 20 penetrates the leg portion 7A in the Y axis direction but may penetrate the leg portion 7A in the X axis direction. When the recess 20 is formed in both the leg portion 7A and the leg portion 7B, if a constitution in which the recess 20 penetrates both the leg portion 7A and the leg portion 7B in the X axis direction is adopted, the recess 20 can be formed in the leg portion 7A and the leg portion 7B at the same time using a cutting tool. The recess 10 or 20 may be formed only in the leg portion 7B.

Figure 5:
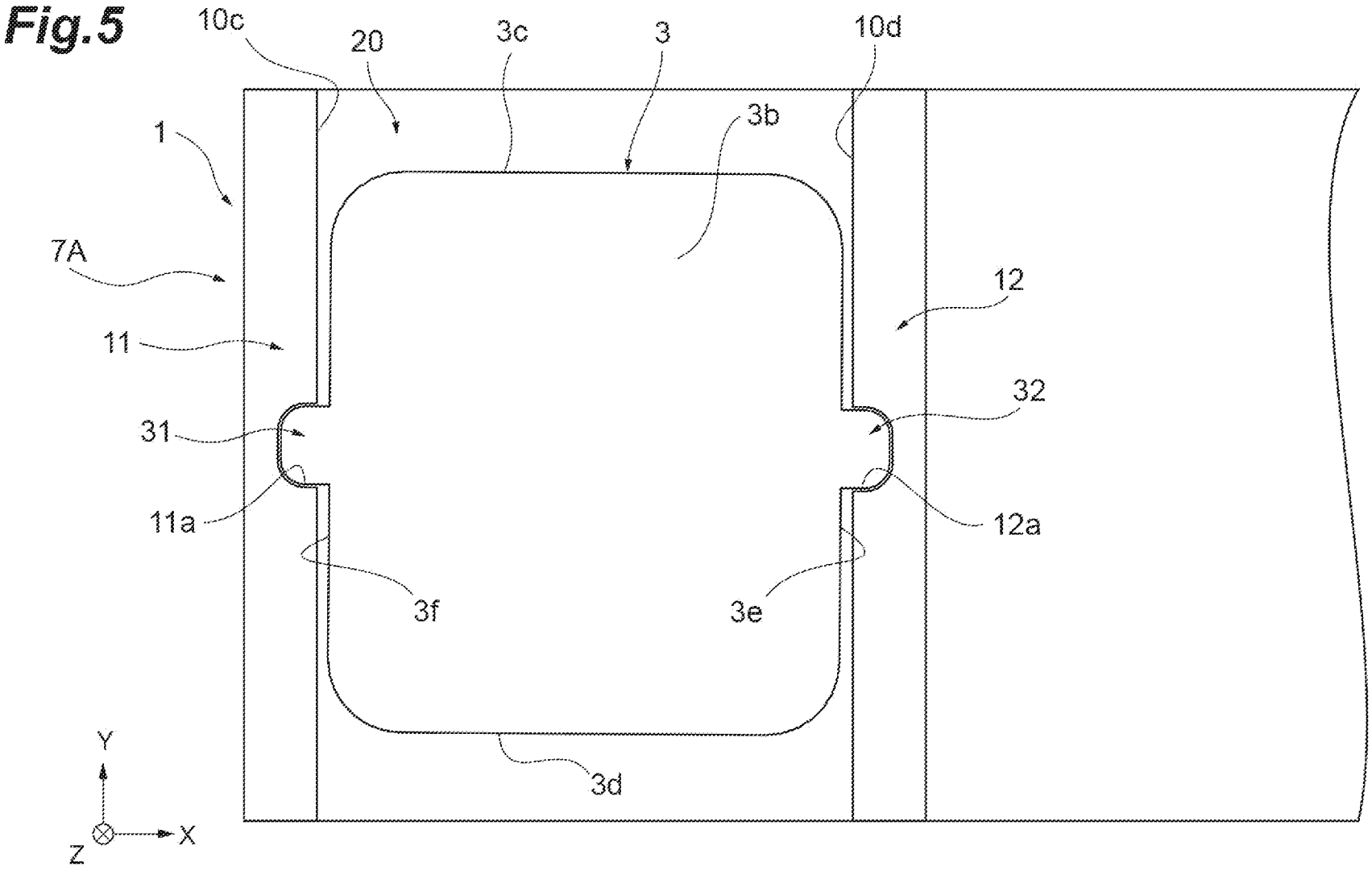
FIG. 5 is an enlarged view of a leg portion and a magnet of the coil component according to the modification example.

In addition, the constitution illustrated in FIG. 5 may be employed. In the constitution illustrated in FIG. 5, protruding portions 31 and 32 protruding toward the first core 1 are formed in the magnet 3. The protruding portion 31 protrudes from the side surface 3*f* toward the negative side in the X axis direction. The protruding portion 31 is inserted into a recessed portion 11*a* formed on the inner side surface 10*c* of the restriction wall portion 11. The protruding portion 32 protrudes from the side surface 3*e* toward the positive side in the X axis direction. The protruding portion 32 is inserted into a recessed portion 12*a* formed on the inner side surface 10*d* of the restriction wall portion 12. Accordingly, movement of the magnet 3 in the Y axis direction can be restricted due to the protruding portions 31 and 32 of the magnet 3 which are fitted into the recessed portions 11*a* and 12*a* of the first core 1.

Figure 6A:
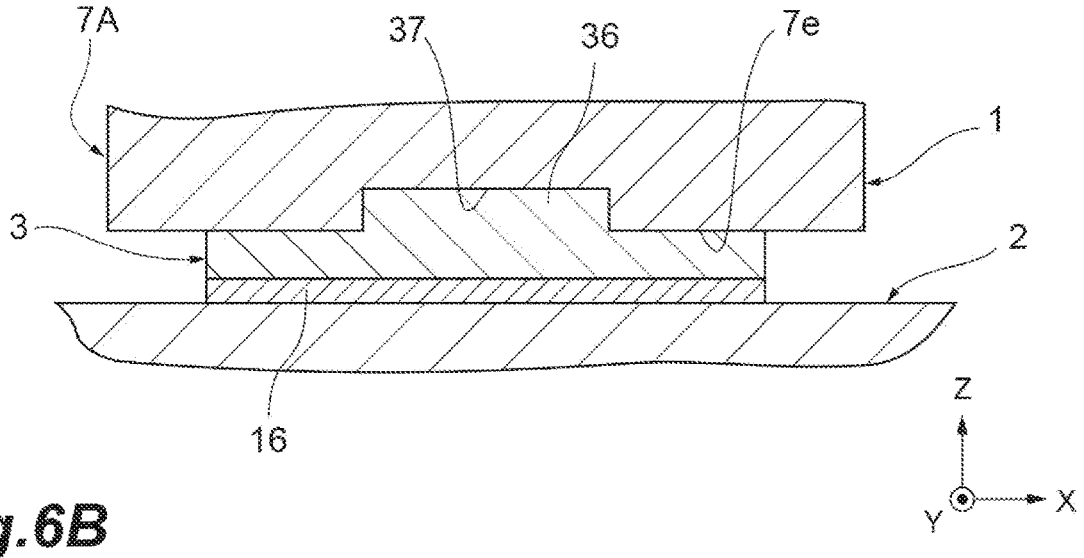
FIGS. 6A, 6B, and 6C are cross-sectional views of the coil component according to the modification example.

In addition, an uneven structure for restricting movement of the magnet 3 in a direction along the XY plane may be formed in any way with respect to any constituent element of the first core 1, the second core 2, and the magnet 3. For example, the constitution illustrated in FIGS. 6A, 6B and 6C may be employed. In the constitution illustrated in FIG. 6A, a protruding portion 36 protruding to the positive side in the Z axis direction is formed in the magnet 3. In addition, the protruding portion 36 is inserted into a recess 37 of the leg portion 7A of the first core 1. Accordingly, movement of the magnet 3 in the X axis direction and the Y axis direction is restricted by the recess 37 of the leg portion 7A via the protruding portion 36. In this manner, an uneven structure for restricting movement of the magnet 3 in at least one of the X axis direction and the Y axis direction is constituted by combining the protruding portion 36 and the recess 37.

Figure 6B:
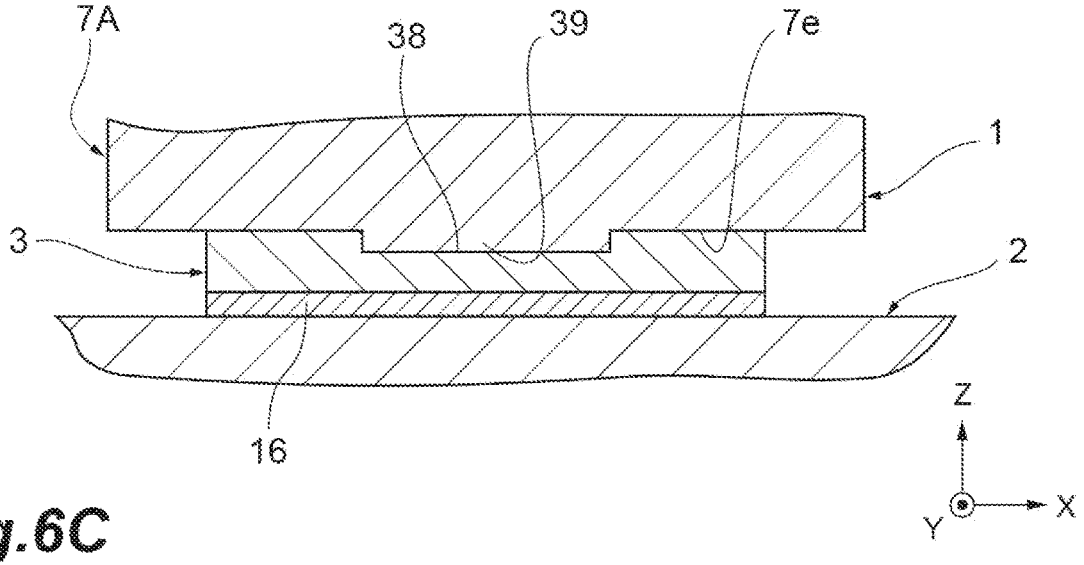

In addition, in the constitution illustrated in FIG. 6B, a recess 38 recessed to the negative side in the Z axis direction is formed in the magnet 3. In addition, a protruding portion 39 of the first core 1 is inserted into the recess 38. Accordingly, movement of the magnet 3 in a direction along the XY plane is restricted by the protruding portion 39 of the leg portion 7A via the recess 38. In this manner, an uneven structure for restricting movement of the magnet 3 in at least one of the X axis direction and the Y axis direction is constituted by combining the protruding portion 39 and the recess 38.

Figure 6C:
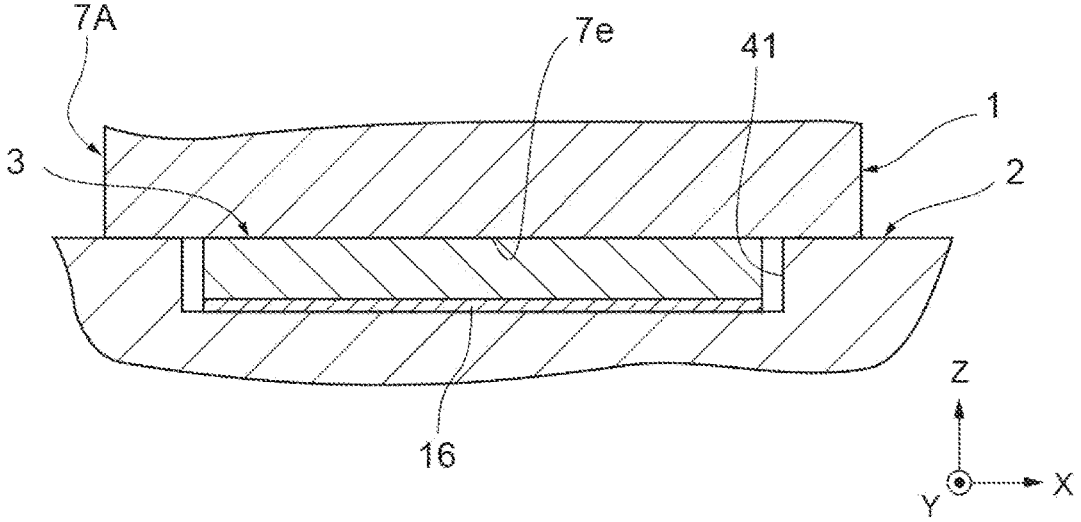

In addition, in the constitution illustrated in FIG. 6C, a recess 41 is formed in the second core 2, and the recess 41 is inserted into the magnet 3. Accordingly, movement of the magnet 3 in a direction along the XY plane is restricted by the recess 41. In this manner, an uneven structure for restricting movement of the magnet 3 in at least one of the X axis direction and the Y axis direction is constituted by the recess 41.

Embodiment 1. A coil component comprising:

a first core having a leg portion;

a second core joined to the first core with the leg portion therebetween; and a magnet disposed between the leg portion and the second core, wherein movement of the magnet in a first direction intersecting an opposite direction in which the first core and the second core face each other is at least restricted by an uneven structure provided on a junction surface between the magnet and at least one of the first core and the second core.

Embodiment 2. The coil component according to embodiment 1, wherein a pair of first restriction wall portions protruding in a manner of facing each other in the first direction are formed in at least one of the first core and the second core, and wherein movement of the magnet in the first direction is restricted by the first restriction wall portions.

Embodiment 3. The coil component according to embodiment 2, wherein a pair of second restriction wall portions protruding in a manner of facing each other in a second direction intersecting the opposite direction and the first direction are formed in at least one of the first core and the second core, and wherein movement of the magnet in the second direction is restricted by the second restriction wall portions.

Embodiment 4. The coil component according to any one of embodiments 1 to 3, wherein a protruding portion protruding toward at least one of the first core and the second core is formed in the magnet.

Embodiment 5. The coil component according to any one of embodiments 1 to 4, wherein the first core has the pair of leg portions, and the magnet is disposed in at least one of the pair of leg portions, and wherein a coil portion is disposed between the pair of leg portions.

REFERENCE SIGNS LIST

1 First core
2 Second core
3 Magnet
7A, 7B Leg portion
10, 20, 38, 41 Recess (uneven structure)
11, 12 Restriction wall (first restriction wall)
13, 14 Restriction wall (second restriction wall)
31, 32, 36, 39 Protruding portion
100 Coil component

What is claimed is:

1. A coil component comprising:

a first core having a main body portion and a leg portion extending from the main body portion in a first direction;

a second core joined to a free end of the leg portion; and a magnet between the leg portion and the second core, wherein:

one of the leg portion and the second core includes a motion restriction surface that is configured to restrict movement of the magnet relative to the leg portion and the second core in a second direction perpendicular to the first direction; and one of (i) the magnet and (ii) the leg portion or the second core includes a protruding portion that is received in and engages a recess in another of (i) the magnet and (ii) the leg portion or the second core such that movement of the magnet is restricted relative to the leg portion and the second core in the second direction by the motion restriction surface.

2. The coil component according to claim 1, wherein:

the motion restriction surface includes a pair of spaced, first restriction wall portions (i) facing each other in a third direction perpendicular to the first direction and the second direction on opposite sides of the magnet and (ii) configured to restrict movement of the magnet in the third direction;

the magnet includes the protruding portion;

the first restriction wall portions form the recess; and the protruding portion is in the recess.

3. The coil component according to claim 1, wherein:

the leg portion includes first and second leg portions that are spaced in the second direction or the third direction;

the magnet is in at least one of the first and second leg portions; and a coil portion is between the first and second leg portions.

* * * * *